United States Patent [19]

Kissell et al.

[11] 4,157,204

[45] Jun. 5, 1979

[54] FACE VENTILATION SYSTEM FOR COAL MINES

[75] Inventors: Fred N. Kissell, Pittsburgh, Pa.; Joseph E. Matta, Bel Air, Md.

[73] Assignee: The United States of America as represented by the Secretary of the Interior, Washington, D.C.

[21] Appl. No.: 928,494

[22] Filed: Jul. 27, 1978

[51] Int. Cl.[2] ..... E21C 35/22

[52] U.S. Cl. ..... 299/64; 299/12; 299/19

[58] Field of Search ..... 299/12, 64, 67; 98/50, 98/19

[56] References Cited

U.S. PATENT DOCUMENTS

| | | | |
|---|---|---|---|
| 2,059,639 | 11/1936 | Hixon | 299/12 X |
| 3,333,896 | 8/1967 | Diamanti | 299/12 |
| 3,439,508 | 4/1969 | Payne et al. | 299/12 |
| 3,464,756 | 9/1969 | Burgess | 299/12 |
| 3,640,580 | 2/1972 | White | 299/12 X |
| 3,715,969 | 2/1973 | Burgess | 299/12 X |

*Primary Examiner*—Ernest R. Purser

*Attorney, Agent, or Firm*—Thomas Zack; Donald A. Gardiner

[57] ABSTRACT

A coal mine ventilation system which insures proper ventilation near the working area. The basic system employs a mining machine on which is mounted a panel on a movable frame, a conventional line curtain fixed to the mine floor and roof and located adjacent to the panel, and an air control fluid spray system. Fluid sprays may be mounted on the machine on the opposite the panel to promote airflow towards the mining face. Additional sprays may be mounted on the machine panel to provide an effective barrier between that panel and the fixed line curtain.

4 Claims, 2 Drawing Figures

FACE VENTILATION SYSTEM FOR COAL MINES

BACKGROUND OF THE INVENTION

1. Field of the Invention

The invention described herein is a ventilation system for use with a mining machine.

2. Description of the Prior Art

Extensible line curtains, such as those described in U.S. Pat. No. 3,715,969, have been known for years. These systems are designed to be used with a mining machine to provide a proper air flow to the machine operator and working face as the machine advances into the coal or ore. Federal regulations for coal mining require that the line curtain be maintained to within 10 feet from the greatest depth of penetration of the coal mine working face. When the extensible line curtain is on a rolling mechanism attached to either the mine floor or roof the possibility for a malfunction is sufficiently great that as a practical matter these types of movable line curtains are not employed. As a result the depth of cut into the coal face can never be greater than the 10 foot distance established by regulation. It would be very desireable for improved productivity to increase the depth of cut beyond 10 feet but at the same time comply with the 10foot regulation relating to the distance required between the line curtain and depth of penetration into the coal.

Our approach to increase this depth of penetration has first been to attach an air control panel or sideboard with a vertical air control screen to the side of the mining machine so that it may move towards the mine face with the machine. Provision has also been made to move the screen vertically to conform to various irregularities in the mine floor to roof distance. To insure that fresh air reaches the machine, a conventional fixed line curtain is attached to the mine on the same side of the movable panel and water or air jet sprays are mounted on the machine. None of the known prior art employs the combined machine mounted movable panel and air flow control as set forth by our invention.

SUMMARY OF THE INVENTION

The face ventilation system making up this invention combines a movable machine mounted panel and an air flow control. Both are mounted on the mining machine with the panel extending along a side thereof. In a direction generally parallel to the machine mounted panel there is a conventional line curtain spaced from a mine wall and mounted between the mine floor and roof. Air flow in the gap between the machine mounted panel and line curtain is reduced by a machine mounted air control device. Similar air control devices, also mounted on the machine, move the air to the front of the machine past the operator towards the mine working face and then—in conjunction with the first air control device and screen/line curtain—into the space between the curtain and mine wall away from the mine face working area.

The primary object of the invention described herein is a improved ventilation system for a mine working face.

Figure 1:
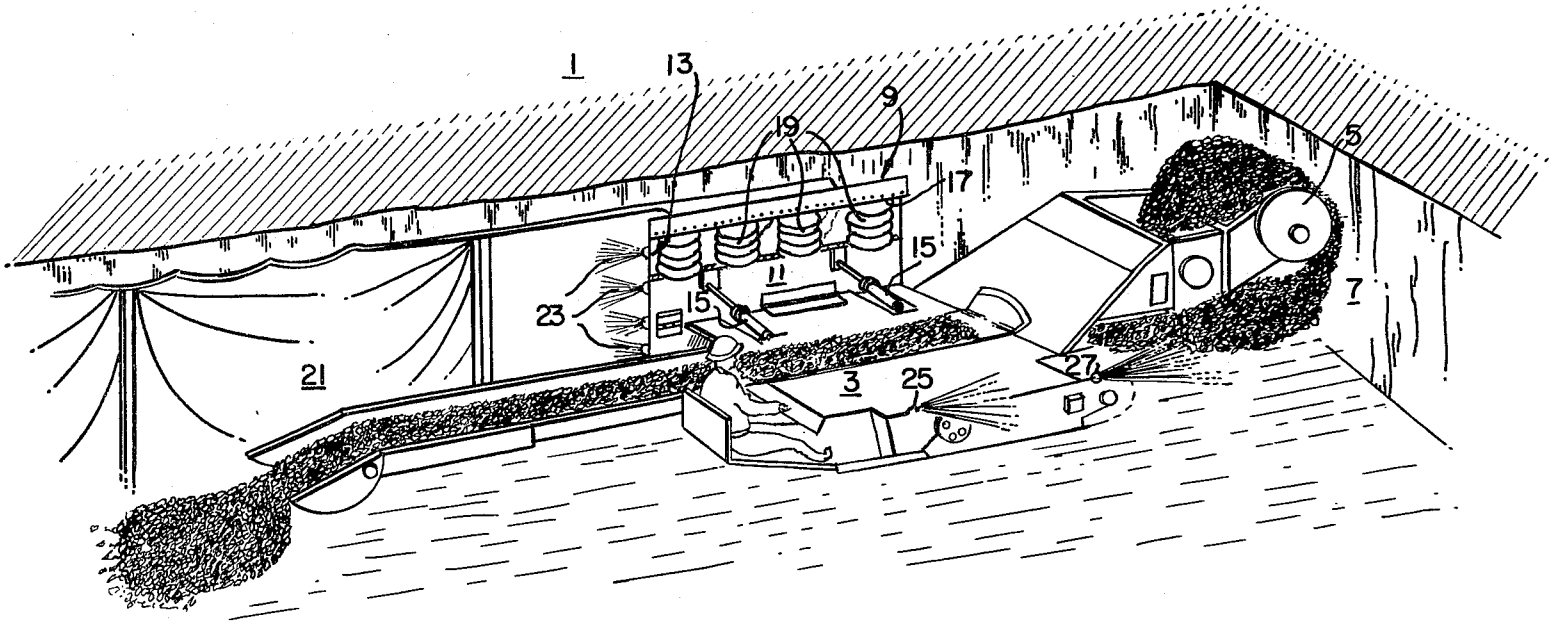
FIG. 1 depicts the preferred embodiment of this invention mounted on a continuous mining machine used to cut coal.

Shown in situ in the coal mine 1 of FIG. 1 is the conventional continuous mining machine 3 with its rotating drum type cutting head 5 which cuts coal from the mine working face 7. Such machines are well known and as such the particular design or type selected is not critical to the preferred embodiment. One example of the type which could be used is the model 11CM manufactered by Joy Manufacturing Co., Franklin, Pa. Extending along one side of the machine and forming part of the frame for the machine is the vertical semirigid air control panel 9 having an upper and lower interconnected portion. The front end of this panel nearest the working face is set at the predetermined distance of 10 feet established by regulation from the cutting head. The lower portion 11 of this panel is made from a rigid material which is mounted by a hinged connection to the machine. The hydraulic system 15 allows the panel and hence the air curtain it forms to be raised or lowered as it pivots on its hinged mount. The upper panel section 17 is made from a flexible material and is approximately the same size and extends in the same direction as the rigid lower portion. Inter-connecting the upper and lower sections of the panel is an air impervious fabric material 13 which also encloses the series (four shown) of parallel inner springs 19. These springs act as frame members to support the panels and also enable the upper portion member to conform to an undulating mine roof. The air control panel 9 is thus made up of the upper and lower panel portions (11 and 17), the four interconnected vertical springs 19, and the interconnecting fabric material 13.

Extending in the same direction as the mine mounted panel 9 and approximately parallel to it is the conventional stationary line curtain 21 used to bring air to the working face. This line curtain is fixed to the mine and extends from the mine floor to roof and is spaced from and generally parallel to the adjacent mine wall and machine mounted panel. It is located to the same side of the machine as the machine mounted panel. When viewed from the side (FIG. 1,) the machine mounted panel would initially overlap with the stationary line curtain 21. Since the front edge of the panel is always the prescribed distance (10 feet) from the cutting head, the effective air barrier provided by the panel is forward of the stationary line curtain alone as the machine advances towards the working face.

Figure 2:
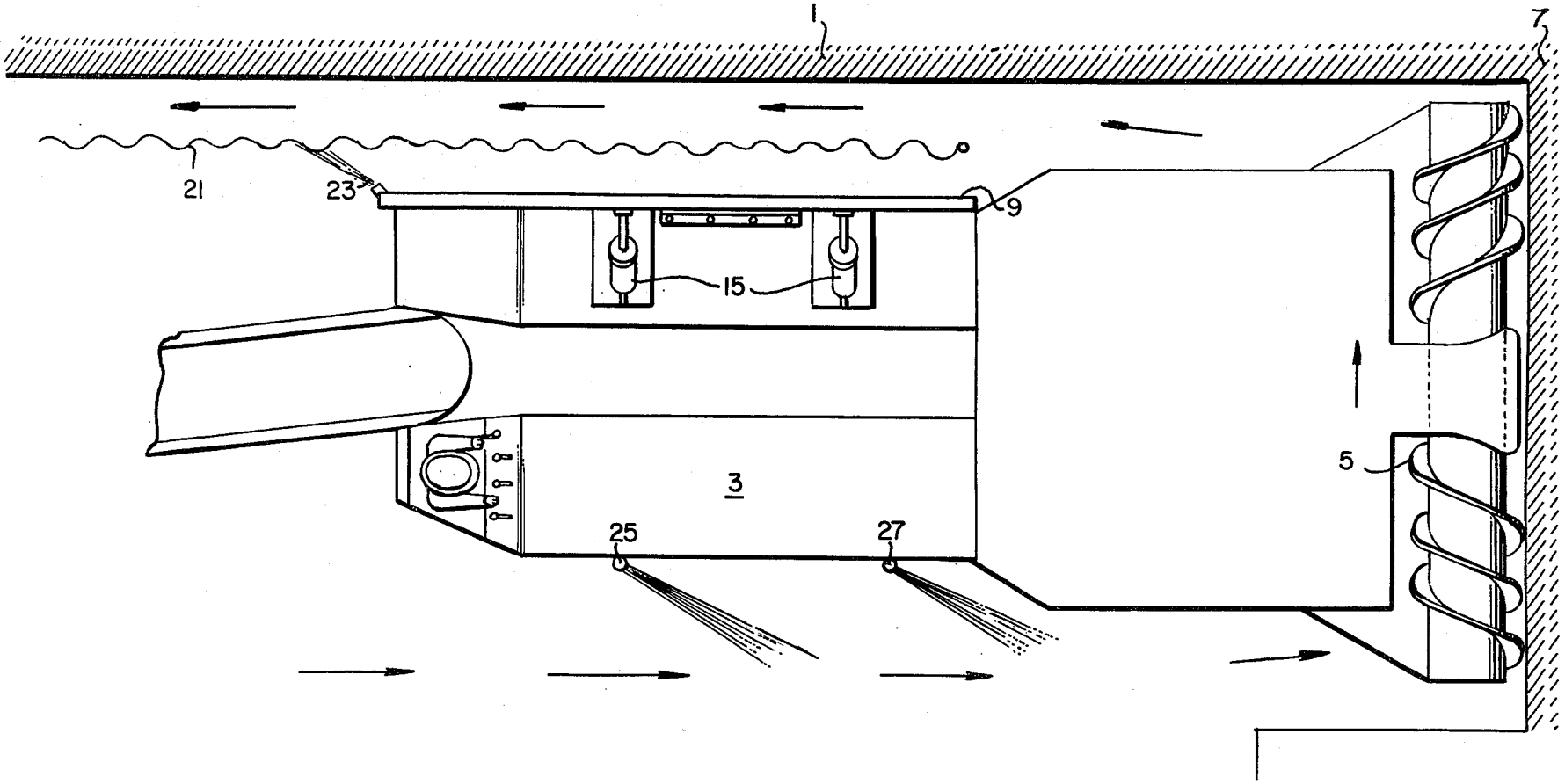
FIG. 2 illustrates a top view of how the FIG. 1 invention would work.

The gap between the line curtain and machine mounted panel (see FIG. 2) is closed to the movement of air by a water barrier produced by a few (four shown) flat jet sprays 23 mounted on the trailing edge of the panel. Similarly a few conical pattern water sprays 25 and 27 on the opposite side of the mining machine reduce the airflow through the gap by inducing an airflow up the opposite side to the working face and in a direction as seen by the arrows of FIG. 2. The effect is to force more air to the cutter head to dilute methane gas and provide better ventilation. In the commonly assigned and copending United States patent application Ser. No. 870,162 filed Jan. 17, 1978, entitled "Ventilation System for Continuous Mining Machines" by F. N. Kissell and R. E. Wallhagen, the use of water sprays to induce an air flow is described in detail. An example of a flat spray nozzle (23) is the Unijet Type T or Type TT nozzle manufactured by Spraying Systems Co., Wheaton, Ill. An example of a conical pattern spray nozzle (25 and 27) is the Unijet Type TD or Type TTD spray nozzle from the same company. Conceivably the sprays 23 could be replaced with an air curtain and sprays 25 and 27 with a diffuser fan aimed forward so as to entrain air and carry it to the mine working face.

Since the machine curtain moves with the machine towards the mine working face, greater cuts (about 20 feet) into the coal face are possible at the same time than an airflow barrier remains within 10 feet of the face. This would lead to increased productivity while complying with safety requirements.

Other variations from the disclosed preferred embodiment are possible. However, none should be used to vary the scope and extent of our invention which is to be measured only the claims which follows.

We claim:

1. A ventilation system for providing proper ventilation near the working area of a mine comprising in combination:

a mining machine having a frontal cutterhead adapted to engage the mine working area to be ventilated;

an air control panel mounted on said mining machine and extending along one side thereof and movable with the machine;

a line curtain fixed to said mine and extending between the mine floor and roof, said curtain being spaced from said mine wall and panel to form fluid conduits between said panel and line curtain and said curtain and mine wall, when in a proper operating mode, extending in the same general direction; and air movement control means mounted on the machine for preventing air flow in the conduit between the panel and line curtain and for promoting the flow of air on the opposite side of the machine towards the cutterheads and into the conduit between the line curtain and wall.

2. The ventilation system of claim 1 wherein:

said machine mounted panel comprises a plurality of separate interconnected elements with the top most elements being vertically movable to adjust to vertical differences between the mine floor and roof.

3. The ventilation system of claim 2 wherein the upper and lower most elements comprise separate parts facing in the same direction, the lower part being made of a semirigid material and pivotally mounted to the machine, the upper part being made of a flexible material, and said parts being connected together by flexible elongated elements.

4. The ventilation system of claim 1 wherein said air movement control means comprises a plurality of fluid sprays mounted at different locations along said machine, at least one of said fluid sprays being mounted on said panel to provide an air barrier in the conduit between said panel and line curtain, and at least one fluid spray mounted on the side of the machine opposite the panel to promote the flow of air forward towards the cutterhead.

* * * * *